United States Patent [19]

Mollon

[11] 4,139,098

[45] Feb. 13, 1979

[54] THREE-WAY TOTE BASKETS

[75] Inventor: Leslie Mollon, Southfield, Mich.

[73] Assignee: Brooks & Perkins, Incorporated, Southfield, Mich.

[21] Appl. No.: 659,981

[22] Filed: Feb. 23, 1976

Related U.S. Application Data

[63] Continuation-in-part of Ser. No. 492,238, Jul. 26, 1974, abandoned.

[51] Int. Cl.[2] ..... B65D 21/04

[52] U.S. Cl. ..... 206/507; 220/23.6

[58] Field of Search ..... 206/507; 220/9 F, 23.6

[56] References Cited

U.S. PATENT DOCUMENTS

| | | | |
|---|---|---|---|
| 2,064,518 | 12/1936 | Brooden | 206/507 |
| 2,823,829 | 2/1958 | Frater | 206/507 |
| 3,052,373 | 9/1962 | Frater | 206/507 |
| 3,147,882 | 9/1964 | Waters | 206/507 |
| 3,270,913 | 9/1966 | Bridenstine et al. | 206/507 |
| 3,379,339 | 4/1968 | Asenbauer | 206/507 |
| 3,416,691 | 12/1968 | Piker | 220/9 F |
| 3,489,314 | 1/1970 | Slapnik | 220/23.6 X |
| 3,491,914 | 1/1970 | Elzey | 206/507 |
| 3,734,341 | 5/1973 | Levenhagen | 206/507 |
| 3,840,115 | 10/1974 | Ladwig | 206/506 |

*Primary Examiner*—William Price
*Assistant Examiner*—Bruce H. Bernstein
*Attorney, Agent, or Firm*—Whittemore, Hulbert & Belknap

[57] ABSTRACT

Generally elongated rectangular baskets formed of injection molded structural plastic foam. The baskets are designed so that they may be nested together or may be stacked with their longitudinal axes parallel or they may be cross-stacked so that access is afforded the contents of intermediate baskets in the stack.

2 Claims, 11 Drawing Figures

32
31
33

26
34
28
36
24

10
33
47
32

7
7
62
36
10
62a
24
46b
70
38
72
40
42
52
46
46a
14
74
8
30
8
28
30a
60a
60
34
50
26

5
36
6
26
56
28
34
4
54
20
18
22
14
12
16
5
6
4

THREE-WAY TOTE BASKETS

CROSS REFERENCE TO RELATED APPLICATION

The present application is a continuation-in-part of my prior copending application, Ser. No. 492,238, filed July 26, 1974, now abandoned.

BRIEF SUMMARY OF THE INVENTION

The invention relates to baskets formed of injection molded structural plastic foam. By injection molding of foamed plastic, the same quantity of plastic per basket results in a substantially thicker wall with consequent increased rigidity. In addition, it has been found that structural plastic foam is particularly resistant to abrasion of the type which occurs when loaded baskets or stacks of baskets are dragged across rough flooring such as concrete floors.

The injection molding further permits full formation of outwardly and downwardly turned flanges, thus imparting increased strength and rigidity to the baskets.

The detailed design of the baskets is such that the baskets may be substantially completely nested so as to minimize the space occupied thereby when not in use.

In addition, when the baskets are turned 180° relative to each other, support surfaces are provided on a lower basket which will support an upper basket in elevated stacked relation in which the bottom of the upper basket is closely adjacent to the top of the lower basket. Finally, the baskets, which are generally elongated and rectangular in cross-section, may be cross-stacked and in this condition include means preventing relative lateral displacement. In the cross-stacked relationship the end portions of a lower basket extend laterally beyond the sides of an upper basket so that access is afforded to the contents of intermediate baskets.

DETAILED DESCRIPTION

Figure 11:
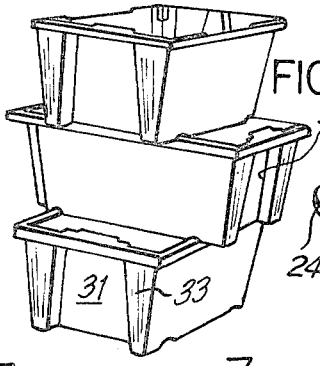
FIG. 11 is an elevational view of baskets in cross-stacked relationship.

The baskets having the shape and structural features illustrated in the drawings are formed by injection molding of a foamed plastic material such for example as high density polyethylene plastic. Since the baskets are formed by injection molding of the foamed plastic, the shape of all portions of the basket may be fully predetermined including the outwardly and downwardly extending continuous flange surrounding the top of the basket. Moreover, since the plastic material is foamed, the wall thickness resulting from a predetermined weight or mass of the plastic will result in a substantially thicker wall formation than would otherwise occur, thus adding strength and rigidity to the basket.

Further, since the final density of the injected foam may vary, it is possible to provide a different density in predetermined portions of the basket, as may be desirable to provide strength or wearing properties at particular locations.

Referring now to the drawings, the baskets, designated in their entirety at 10, are provided with substantially flat bottom walls 12 which are provided with transverse ribs 14 acting as stiffeners and adjacent the ends thereof with downwardly open channels 16 spaced apart a distance corresponding to the transverse width of the top portions of the basket for a purpose which will presently appear.

Figure 10:
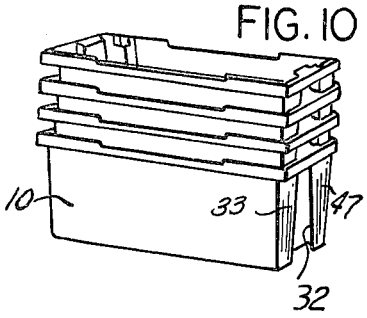
FIG. 10 is an elevational view of the baskets in nested relationship.

In general terms it will be noted that the end walls 18 and 20 of the basket, as well as the side walls 22, are downwardly and inwardly inclined so that with a proper internal configuration the baskets 10 may nest substantially completely as illustrated in FIG. 10.

The top edge of the basket includes generally flat upwardly facing surface portions 24 which extend completely across the ends of the basket and extend along the sides thereof to a depressed top edge portion 26 which is dimensioned to be received in the downwardly opening channels 16 to produce a cross-stacked relationship as best illustrated in FIG. 11.

Figure 4:
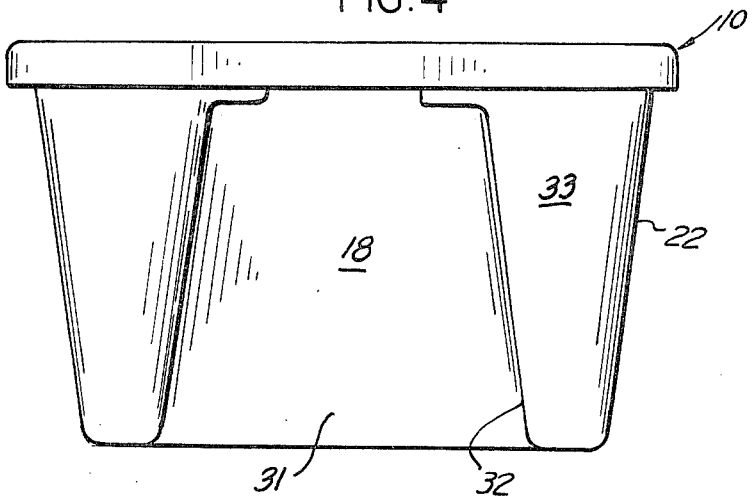
FIG. 4 is a view of the end of the basket.
Figure 7:
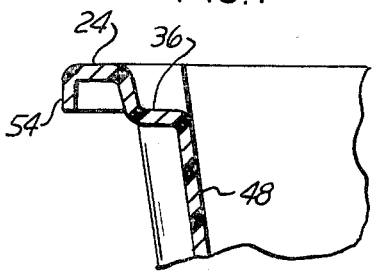
FIG. 7 is a fragmentary sectional view on the line 7—7, FIG. 2.
Figure 8:
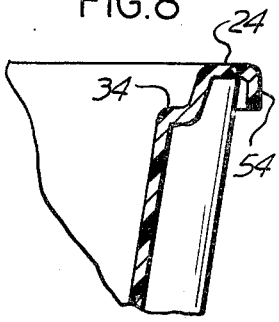
FIG. 8 is a fragmentary sectional view on the line 8—8, FIG. 2.
Figure 9:
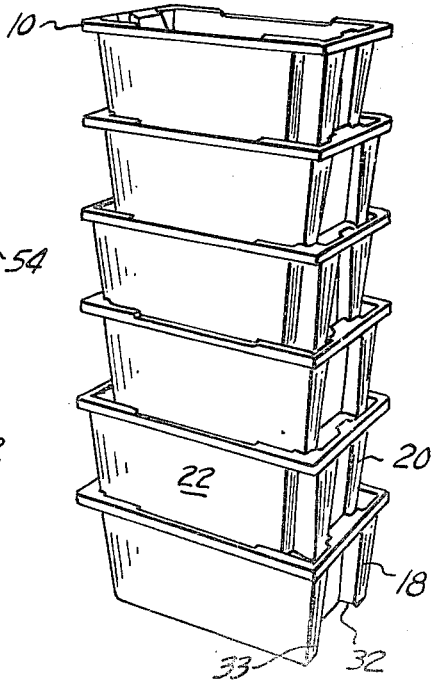
FIG. 9 is a perspective view of the baskets in stacked relationship.

In order to provide the stacked relationship illustrated in FIG. 9, the end walls 18 and 20 of the baskets are differently formed. The end wall 18 is provided with a tapered inwardly projecting relatively wide rib 28 having upwardly converging side wall portions 30 and a transversely extending upwardly and longitudinally outwardly inclined inner surface **30*a*, the rib 28 forming an external channel 31 between external wall portions 32 and external ribs 33 in FIGS. 4 and 11. Provided in the upper portion of the rib 28 are slightly depressed basket supporting seat surfaces 34**.

At the opposite end, the end wall 20 of the basket is formed to provide basket supporting seats 36 which are located at the same horizontal level as the seats 34, both being adjacent the top of the basket. The end wall 20 intermediate the seats 36 tapers downwardly and inwardly as indicated at 38, and centrally thereof there is provided an inwardly extending rib 40 having upwardly converging side walls 42, the rib 40 forming two downwardly narrowing internal channels 43 defined between inclined end wall portions 38, the inclined side walls 42, and the side wall portions 46 extending downwardly from the seats 36. This arrangement provides downwardly converging external ribs 47 at the end 20 of each basket, the ribs having downwardly converging side wall surfaces 48 and **48*a*. At the outside of the ends 20 of the basket, intermediate the ribs 47 there is thus provided a downwardly and outwardly tapered recess or channel 49*a***.

Figure 2:
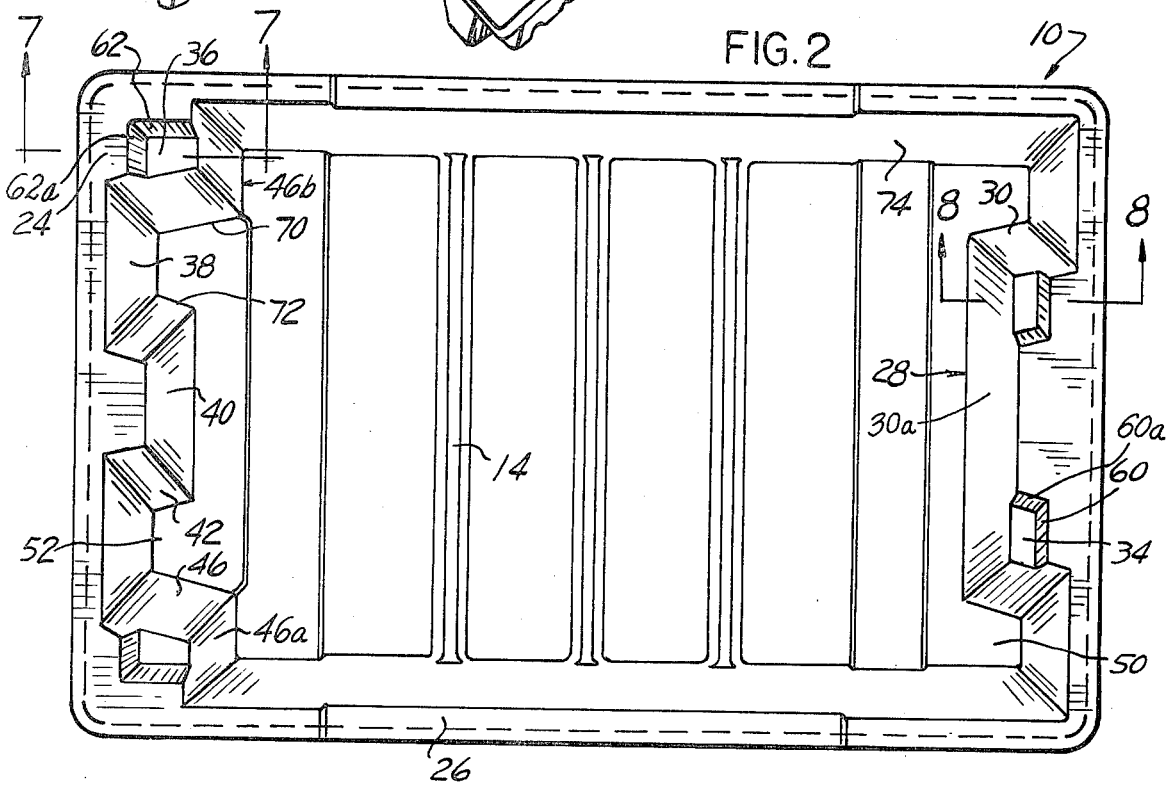
FIG. 2 is an enlarged plan view of the basket shown in FIG. 1.
Figure 3:
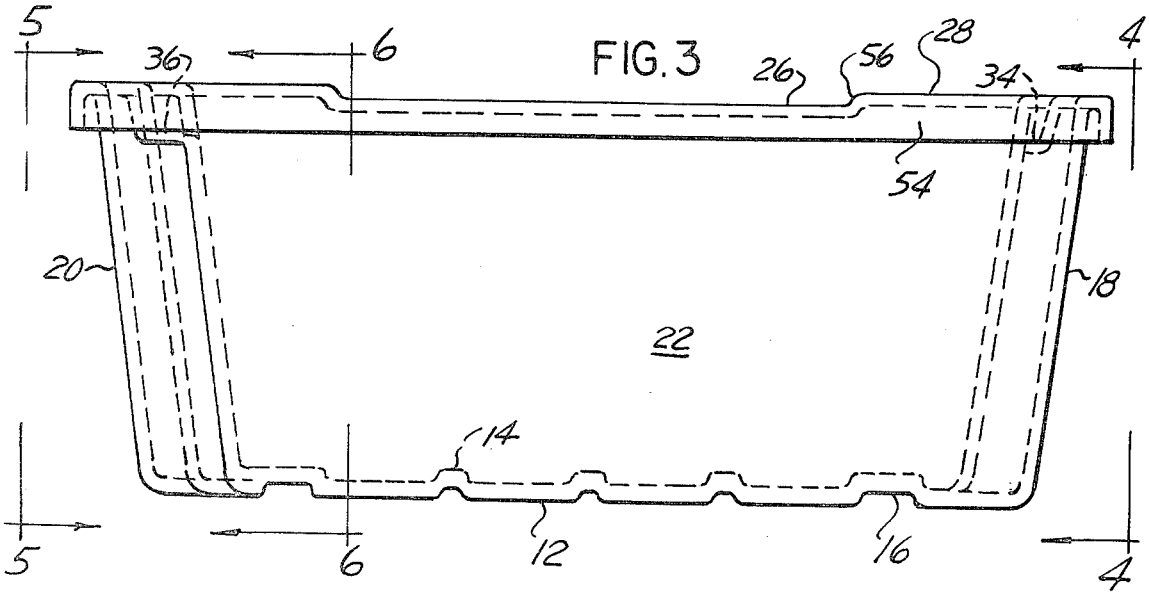
FIG. 3 is a side elevational view of the basket.

Referring now to FIG. 9 it will be observed that when the baskets are turned so that corresponding ends of adjacent baskets are at opposite ends of the stack, the baskets may be stacked in an arrangement in which the bottom of an upper basket engages seats provided at the ends of a lower basket so as to support the upper basket in elevated position with respect to the lower basket. Corner portions of the bottom wall 12, designated 50 in FIG. 2, are adapted to rest on the seats 36 of the lowermost basket. Similarly, bottom wall portions 52 are adapted to rest on the seats 34. seats 34 and 36, as best seen in FIG. 3, are in a horizontal plane located adjacent the top of the basket and incidentally, occupy the plane defined by the lower edge of the downwardly extending flanges 54.

At the interior of the basket at the end 20 thereof, inclined walls 46 and 46*a* define therebetween pillars 46*b* which adjacent their upper ends have the seats 36. Walls 46 are inclined upwardly and laterally outwardly, and walls 46*a* are inclined upwardly and longitudinally outwardly.

Figure 1:
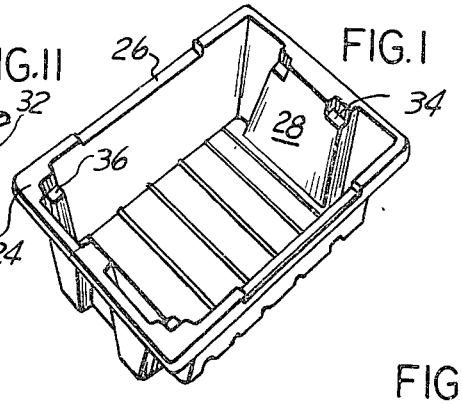
FIG. 1 is a perspective view showing the structure of the baskets.
Figure 5:
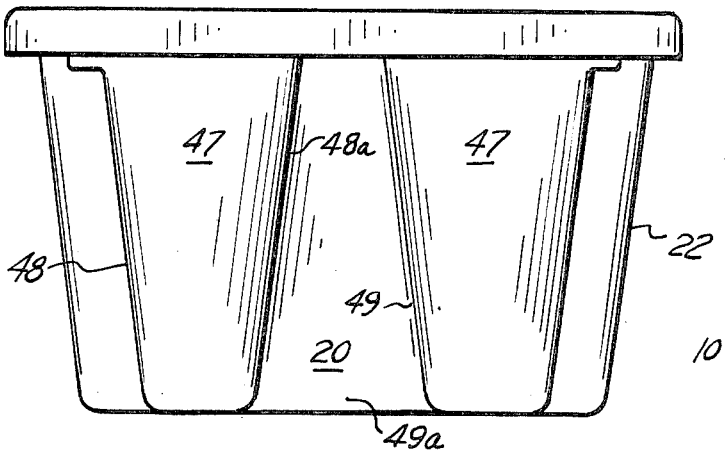
FIG. 5 is a view of the other end of the basket.
Figure 6:
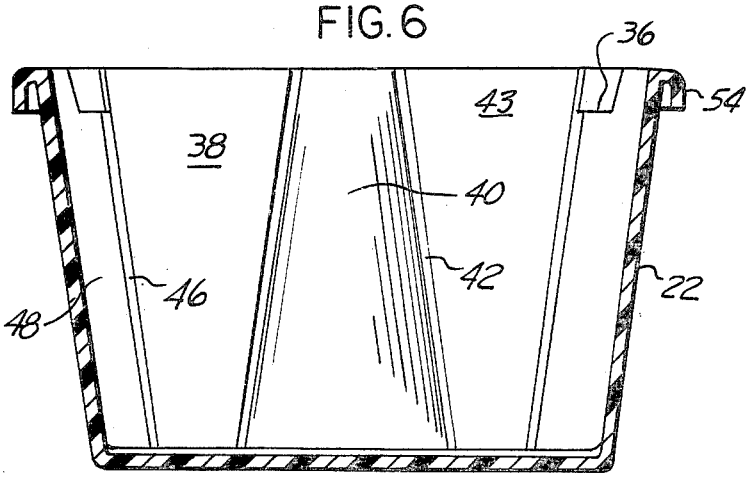
FIG. 6 is a sectional view on the line 6—6, FIG. 3.

Referring now to FIG. 10 the baskets 10 are illustrated in stacked relation, in which corresponding ends of the baskets are located at the same end of the stack. In this arrangement it will be apparent that the outwardly open channels 31 at the ends of the baskets are shaped to interfit with the correspondingly shaped downwardly diverging inwardly extending ribs 28, the shape of which is best illustrated in FIG. 1. At the opposite end of the basket the inwardly facing rib 40 is adapted to be received in the space between the downwardly tapered external ribs 47. This relationship is best understood by comparing FIGS. 5 and 6 and considering that the external formation illustrated in FIG. 5 is movable downwardly to interfit with the end wall formation illustrated in FIG. 6.

In addition to stacking and nesting as above described, the baskets may be cross-stacked as illustrated in FIG. 11. In this arrangement the individual baskets are retained against lateral displacement by interfitting shoulders. Thus, the downwardly open grooves or channels 16 best seen in FIG. 3, are adapted to receive the upper edge portions 26 illustrated in FIG. 2. In addition, the edge portions 26 are depressed below edge portions 28, providing locating shoulders at 56.

As previously described, the basket construction is produced by injection molding of foamed plastic material with the result that all portions including the outwardly extending edge portions 24 and 26 and the down-turned flange 54, are fully formed and constitute effective stiffening and strengthening portions of the side and end walls of the basket.

Where reference has previously been made to portions at the corner or adjacent the end walls of the basket being supported in seats 34 and 36, it will further be observed that above the seats 34 inclined side guide and locating walls 60 and 60*a* are provided. Side walls 60 extend transversely and are inclined upwardly and longitudinally outwardly from the surface 34. Side walls 60*a* extend generally longitudinally and are inclined upwardly and transversely inwardly from the surface 34. Side guide and locating walls 62 extend longitudinally and are inclined upwardly and laterally outwardly from the surface 36. Side guide and locating walls 62*a* extend transversely and are inclined upwardly and longitudinally outwardly from the surface 36. These side walls respectively engage corresponding inclined external wall portions of the upper basket, so that the baskets are not only supported in elevated position, but are firmly located against lateral displacement in any direction. Similarly, when the baskets are nested as illustrated in FIG. 10, the corresponding inwardly inclined wall surfaces interfit so that a solid nested arrangement of baskets results.

From the foregoing description, and as best seen in FIG. 2, the longitudinally extending side guide and locating surfaces 60*a* and 62 are perpendicular to the transversely extending side guide and locating surfaces 60 and 62*a* in horizontal section, thus providing maximum load bearing capacity and rigidity. The construction is readily provided, since as previously stated, fabrication is by injection molding of foamed plastic.

It will be observed that the downwardly sloping walls 42 and 46, at the left hand end of the basket as viewed in FIG. 2, which with end wall portions 38 define inwardly facing channels, have a compound inclination which is best apparent by the divergence of intersection lines 70 and 72 to the right. Thus, the channel has side walls which diverge as viewed in horizontal planes, a condition which reduces any tendency for small parts, such as nuts, bolts, or the like, from jamming or wedging in the channels.

A similar feature is provided at the end 18 of the basket, where inclined walls 30 diverge in horizontal section from side walls 74.

What I claim as my invention is:

1. Stacking and nesting baskets each having a continuous peripheral top wall, a bottom wall, and upwardly and outwardly sloping side and end walls, the end wall at one end of each backet having a single wide centrally located interior rib extending from the bottom of said basket to the top wall thereof, said rib having upwardly converging side walls connected by an upwardly and outwardly inclined intermediate wall, said rib being formed adjacent its upper end with a pair of seats each indented in the top corners of said rib and intersecting the intermediate wall and one of the side walls of said interior rib, and located slightly below the top of said basket, said seats accordingly being spaced laterally inwardly from the side walls of said basket, the indentations in the top corners of the rib forming the seats each having a horizontal seating surface and a transversely extending upwardly and longitudinally outwardly inclined side guide and locating wall facing the opposite end of the basket and connecting said seats to said top wall, the outer surface of said one end of said basket having an outwardly concave groove matching said internal rib, the bottom wall of said basket at said one end thereof having corner seating portions coplanar therewith at opposite sides of said interior rib defined between the side and end walls of said basket and the side walls of said interior rib, and hence extending to the extreme corners at said one end of said basket at the bottom thereof, the end wall at the other end of said basket having corner pillars extending from the bottom of said basket to the top thereof, said pillars each having a first wall inclined upwardly and outwardly toward the adjacent side of said basket and a second wall inclined upwardly and outwardly toward the adjacent end of said basket, each of said pillars having a seat indented into the top corner portion thereof adjacent its upper end intersecting said first and second inclined walls of said pillar and located slightly below the top of said basket at the same horizontal level as the seats at the said one end of said baskets, the seats at the said other end of said basket being located adjacent the top corners thereof and accordingly being spaced laterally thereat beyond the seats at the said one end of said basket, the indentations at the upper corners of the corner pillars having horizontal seating surfaces and longitudinally extending upwardly and laterally outwardly inclined side guide and locating walls connecting said last mentioned seats to said top wall and transversely extending upwardly and longitudinally outwardly inclined side guide and locating walls connecting said last mentioned seats to said top walls, the longitudinally and transversely extending guide and locating walls being substantially perpendicular to each other in horizontal section, the bottom wall at the said other end of said basket extending longitudinally of said last mentioned basket into the space between said pillars to form seating portions coplanar with the bottom wall of said basket and in longitudinal alignment with at least a portion of the seats provided at the said one end of said basket, the seating portions at the said one end of said basket being in longitudinal alignment with at least a portion of the seats provided at the said other end of said basket, the end wall at said other end of said basket being provided with a centrally located interior rib substantially narrower than the interior rib at said one end of said basket and extending from the bottom of said basket to the top thereof, said rib having upwardly converging side walls connected by an upwardly and outwardly inclined intermediate wall, the end wall at said other end of said basket having at its exterior an upwardly tapered channel conforming to the interior rib and shaped to receive the corresponding interior rib of a similarly oriented basket in nested relationship therebeneath.

2. Baskets as defined in claim 1 in which the entire basket is a unitary article formed in its entirety of injection molded rigid structural foamed plastic material.

* * * * *